US010264945B2

(12) United States Patent
Zhao

(10) Patent No.: US 10,264,945 B2
(45) Date of Patent: Apr. 23, 2019

(54) METHOD AND APPARATUS FOR WASHING ARTICLES

(71) Applicant: JCS-Echigo Pte Ltd, Singapore (SG)

(72) Inventor: Liang Zhao, Singapore (SG)

(73) Assignee: JCS-Echigo Pte Ltd, Singapore (SG)

( * ) Notice: Subject to any disclaimer, the term of this patent is extended or adjusted under 35 U.S.C. 154(b) by 117 days.

(21) Appl. No.: 14/408,327

(22) PCT Filed: Jun. 3, 2013

(86) PCT No.: PCT/SG2013/000228

§ 371 (c)(1),
(2) Date: Dec. 16, 2014

(87) PCT Pub. No.: WO2013/191650

PCT Pub. Date: Dec. 27, 2013

(65) Prior Publication Data

US 2015/0190031 A1 Jul. 9, 2015

(30) Foreign Application Priority Data

Jun. 19, 2012 (SG) ..... 201204610-8

(51) Int. Cl.
*A47L 15/24* (2006.01)
*A47L 15/00* (2006.01)
(Continued)

(52) U.S. Cl.
CPC ..... *A47L 15/241* (2013.01); *A47L 15/0076* (2013.01); *A47L 15/13* (2013.01);
(Continued)

(58) Field of Classification Search
None
See application file for complete search history.

(56) References Cited

U.S. PATENT DOCUMENTS 3,709,732 A * 1/1973 Thomen ..... A47L 15/0076 134/184
4,226,325 A * 10/1980 Vandas ..... B65G 45/02 118/70
(Continued)

FOREIGN PATENT DOCUMENTS

CN 2522187 Y 11/2002
CN 1889240 A 1/2007
(Continued)

OTHER PUBLICATIONS

Daniel Miller, Starting a small restaurant, 2006, The Harvard Common Press, Inc., ISBN page, paragraph discussing presoak, paragraph discussing Automatic dishwashers and forecefull spray.*
(Continued)

*Primary Examiner* — Shamim Ahmed
(74) *Attorney, Agent, or Firm* — Carlson, Gaskey & Olds, P.C.

(57) ABSTRACT

A device for washing articles includes a pre-wash section for the removal of particles from the articles, a wash section for the removal of residue from the articles, a pre-wash conveyor for conveying the articles in the pre-wash section, and a wash conveyor for conveying articles in the wash section. The pre-wash conveyor and the wash conveyors are separate with the pre-wash conveyor terminating at the commencement of the wash conveyor, and the articles are transferred from the pre-wash conveyor to the wash conveyor.

12 Claims, 3 Drawing Sheets

(51) Int. Cl.
*B08B 3/12* (2006.01)
*B08B 3/00* (2006.01)
*A47L 15/13* (2006.01)

(52) U.S. Cl.
CPC ..... *A47L 15/247* (2013.01); *B08B 3/12* (2013.01); *A47L 2401/04* (2013.01); *A47L 2601/17* (2013.01); *B08B 3/00* (2013.01)

(56) References Cited

U.S. PATENT DOCUMENTS 4,326,551 A * 4/1982 Voorhees ..... A47L 15/4291 134/107
4,344,448 A * 8/1982 Potts ..... B08B 3/02 134/108
5,441,063 A * 8/1995 Fernandez ..... B08B 9/32 134/142
5,529,191 A * 6/1996 Washeim ..... B65B 21/183 198/370.01
5,898,024 A * 4/1999 Talley ..... C04B 41/5315 510/197
6,309,518 B1 * 10/2001 Schievano ..... B65G 17/04 204/202
6,755,202 B1 * 6/2004 Scholey ..... B08B 9/32 134/158
7,328,712 B1 * 2/2008 Zuck ..... B08B 3/12 134/135
2006/0107486 A1 * 5/2006 Andre ..... B08B 1/02 15/302
2007/0123999 A1 * 5/2007 Raghibizadeh ..... A61L 2/24 700/1
2007/0266677 A1 * 11/2007 Nagatani ..... B65B 55/025 53/467
2008/0245394 A1 * 10/2008 Doherty ..... A47L 15/241 134/21
2009/0038640 A1 * 2/2009 Kestler ..... B08B 1/02 134/6
2009/0159098 A1 * 6/2009 Schepers ..... A47L 15/0023 134/18
2013/0031872 A1 * 2/2013 Blaiss ..... D06B 13/00 53/435

FOREIGN PATENT DOCUMENTS

| | | | | |
|---|---|---|---|---|
| CN | 101596534 | | 12/2009 | |
| CN | 201823725 | U | 5/2011 | |
| CN | 202021178 | | 11/2011 | |
| CN | 202021178 | U * | 11/2011 | ..... B08B 3/12 |
| CN | 202625270 | U | 12/2012 | |
| DE | 4308345 | | 9/1994 | |
| JP | H08332462 | | 12/1996 | |
| WO | 93/06947 | | 4/1993 | |
| WO | 00/53076 | | 9/2000 | |
| WO | 2010/038291 | A1 | 2/2012 | |

OTHER PUBLICATIONS

International Search Report and Written Opinion for International Application No. PCT/SG2013/000228 dated Aug. 22, 2013.

* cited by examiner

METHOD AND APPARATUS FOR WASHING ARTICLES

REFERENCE TO RELATED APPLICATION

This application is a United States National Phase application of PCT Application No. PCT/SG2013/000228 filed on Jun. 3, 2013, which claims priority to Singapore Application No. 201204610-8 filed on Jun. 19, 2012.

FIELD OF THE INVENTION

The invention relates to a process and apparatus for washing articles such as dishes, cutlery, etc. In particular, the invention relates to an automated and continuous washing process.

BACKGROUND

The washing of high volumes of consumer items, particularly those that require regular washing, for example dishes and cutlery from food centres and airline catering, are conventionally washed by hand involving a highly labor intensive batch or continuous process. Such processes typically involve inefficient use of water with water consumption relatively high and on a per article basis extremely high. Despite this excessive water consumption, the inefficient water use may also lead to cross contamination, where food particles of a previous batch are insufficiently disposed of prior to the cleaning of the batch. It follows this represents a significant health risk.

More recently, automated processes have been adopted so as to solve the labor intensive aspect. In such systems, the articles are loaded into crates or baskets and passed through various stations via a conveyor belt, so as to systematically undergo rinsing, detergent washing and drying. Such an approach is also less water intensive with water management more controllable than the former manual method.

Nevertheless, cross contamination is still an issue as the conveyors and reusable baskets or crates may still carry food particles, or other such material, and so affect the cleanliness of subsequent batches.

SUMMARY OF INVENTION

A device for washing articles includes a pre-wash section for the removal of particles from the articles, a wash section for the removal of residue from the articles, a pre-wash conveyor for conveying the articles in the pre-wash section, and a wash conveyor for conveying articles in the wash section. The pre-wash and wash conveyors are separate, with the pre-wash conveyor terminating at the commencement of the wash conveyor, and the articles are transferred from the pre-wash conveyor to the wash conveyor.

A method for washing articles includes the steps of conveying the articles through a pre-wash section on a pre-wash conveyor, removing particles from the articles, transferring the articles from the pre-wash conveyor to a wash conveyer, conveying the articles through a wash section, and removing residue from the articles.

Accordingly, by including a pre-wash process prior to the washing process, and further, by providing a physical separation between the carriers of the pre-wash and carriers of the washing process, the source of cross-contamination is eliminated.

BRIEF DESCRIPTION OF DRAWINGS

It will be convenient to further describe the present invention with respect to the accompanying drawings that illustrate possible arrangements of the invention. Other arrangements of the invention are possible and consequently, the particularity of the accompanying drawings is not to be understood as superseding the generality of the preceding description of the invention.

DETAILED DESCRIPTION

Figure 1:
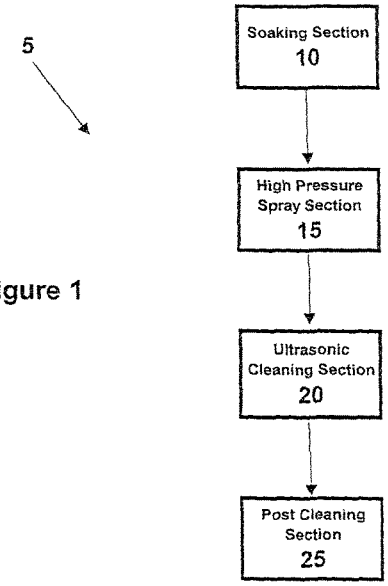
FIG. 1 is a flow chart showing a process according to one embodiment of the present invention.

FIG. 1 shows a flow chart for a process 5 for the cleaning of articles. The process 5 commences with a soaking section 10 so as to soften waste material, such as food scraps, which may be encrusted on the articles which, for the purposes of this description, shall be referred to as dishes.

The soaked dishes are then delivered to a high pressure spray section 15 whereby the softened material is removed from the dishes. The dishes are then passed to an ultrasonic cleaning section 20 whereby they are passed through an ultrasonic bath so as to remove any final material which may have become embedded and not removed in the previous sections. At this stage, there is a high degree of confidence that the articles/dishes are not free from waste material. Because the pre-cleaning apparatus is not directed to the article carrier or conveyor, that degree of confidence does not apply.

The soaking, high pressure spray and ultrasonic cleaning sections represent the pre-wash phase. The dishes are then removed from the pre-wash carriers and placed in carriers for the cleaning section 25.

The cleaning section 25 may be a cleaning device according to the prior art. In this case, whilst the cleaning device may be designed to remove food particles from the dishes, in fact, all food particles have now been removed with only residue, such as grease, oil and fats, remaining to be removed.

Alternatively, the cleaning section 25 may be a dedicated cleaning device arranged for the specific removal of residue such as grease, oil and fats on the basis that all food particles have already been removed.

Figure 2A:
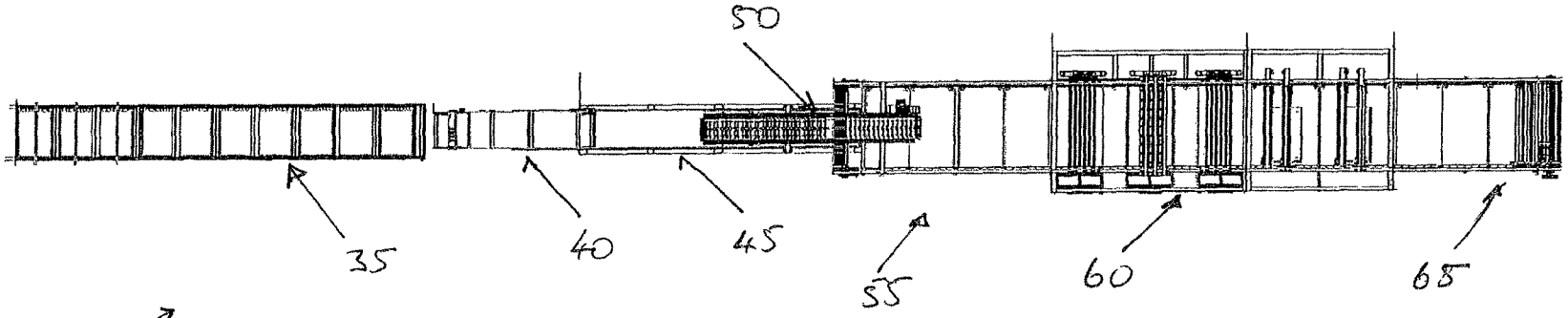
FIGS. 2A and 2B are various views of a system for the washing of articles according to a further embodiment of the present invention.
Figure 2B:
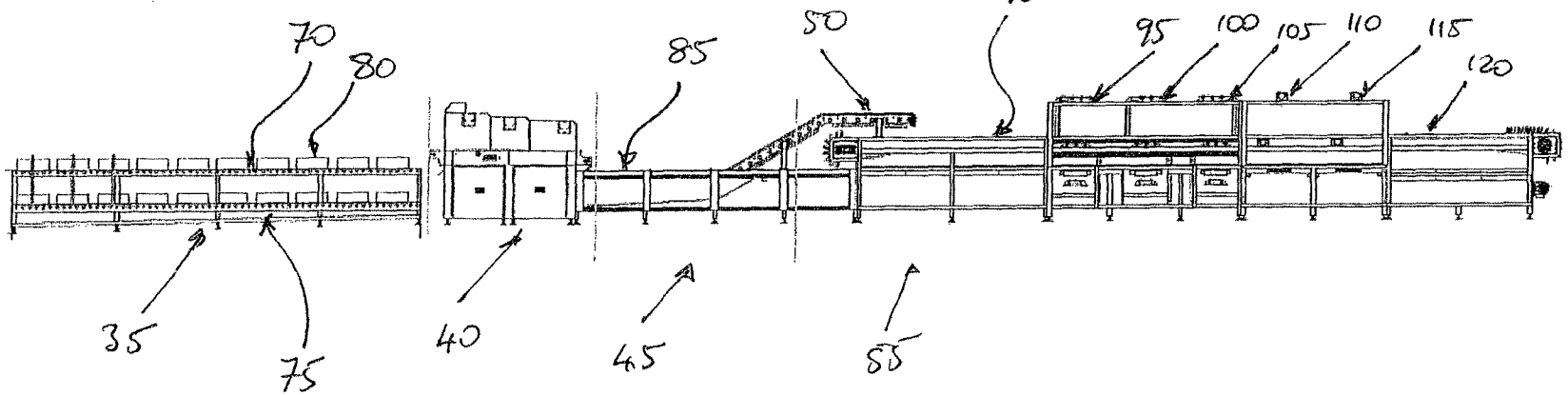

FIGS. 2A and 2B show a washing device for continuous automated washing of dishes and cutlery. The device 30 has a soaking section 35, a high pressure spray section 40, an ultrasonic washing section 45, and a loading section 55 for loading dishes from the pre-wash phase 35, 40, 45 into the washing phase 60. The dishes are then unloaded 120 at the end of the device.

In particular, the soaking section 35 includes two conveyors 70, 75 arranged to convey baskets or crates 80 of dirty dishes to which are exposed a soaking spray. The residence time in the soaking section 35 for the dishes exposed to the soaking spray is sufficient for the soaking of encrusted food particles on the dishes. Whilst it is not expected that a high proportion of the food particles will be removed in this section, it is intended that the adhesion of the food particles to the plates is sufficiently reduced for downstream sections.

The high pressure section spray 40 then either receives the crates of soaked dishes, or unloads the dishes from the crates for direct application of a high pressure spray in order to remove the soaked food particles from the dishes. It should be noted that the soaking section 35 may also act as a buffer for containing a quantity of dishes so as to avoid a bottle neck in the high pressure spray section 40. To this end, the residence time in the soaking section may be further enhanced by increasing the soaking for more efficient removal of food particles.

As a final pre-wash stage, the dishes are then passed through one or more ultrasonic baths 85 so as to be immersed in the ultrasonic bath. The bath, or baths, includes ultrasonic transducers therein so as to apply ultrasonic waves to the articles as a final quality check that all food particles have been removed.

The dishes are then loaded onto a wash conveyor 90 from the ultrasonic conveyor 50. In the present embodiment each of the sections 35, 40, 45 have separate conveyors so that any food particles locked onto the conveyor are not then transferred to the downstream sections. The conveyor 50 from the ultrasonic bath does not transfer the pre-wash carriers such as baskets (not shown) to the washing stage 60. Thus, the second source of cross-contamination found in the prior art is removed. It will be appreciated that the pre-wash section and wash section are physically separated through the transfer of dishes from one conveyor 50 to the wash conveyor 90. Thus, whilst in this embodiment each pre-wash section has a distinct conveyor system, it is sufficient within the present invention that the conveyor of the pre-wash section is distinct from the conveyor of the wash section.

In the wash section 60, the washing device may be similar to that of the prior art in that the original design may be adapted for the complete washing of plates including the removal of food particles. However, when coupled with the pre-wash section according to the present invention, such a design is unnecessary as dishes reaching the wash section 60 will already have food particles removed.

Alternatively, the invention may include a wash section which is specifically adapted for the removal of grease, oil and fat from the dishes and so more efficiently designed given that food particles are assured to have been removed in the upstream portions of the device.

In the present embodiment, the cleaning section moves the dishes from the loading conveyor 90 to a spray rinse 95 followed by a final rinse 100 prior to a sterilizing spray 105. This series of rinse stations may be useful to ensure that any moisture lost during the transfer from the pre-wash section to the wash section is replaced during the rinse. The rinse stations are designed to ensure the removal of grease, oil and fat from the dishes so as to provide a continuous flow of clean dishes to the blow-dry stations 110, 115 prior to the unloading section 65 to be unloaded from the conveyor 120.

Figure 3:
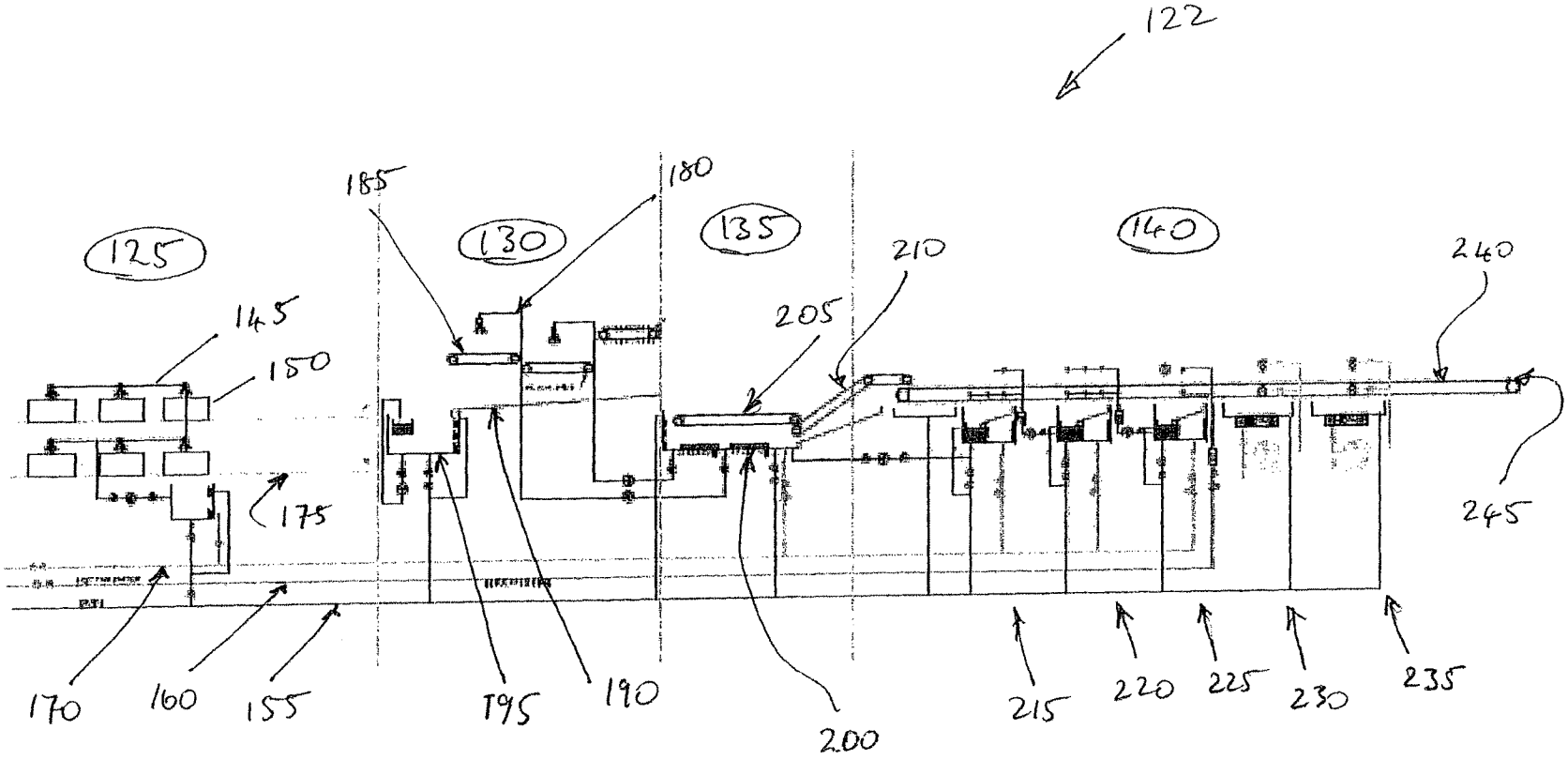
FIG. 3 is a schematic view of a system for the washing of articles according to a further embodiment of the present invention.

FIG. 3 is a schematic view of a washing device according to another embodiment of the present invention. As with the previous embodiment, the device 122 has a soaking section 125, a high pressure spray section 130, an ultrasonic washing section 135, and a washing section 140.

The schematic indicates the various supply lines including cold water 170 and hot water 160, including a drain line 155 with all 3 being common to the entire device 122.

The soaking section shows the array of soaking sprays 145 for delivering a soaking spray 145 to a plurality of baskets 150 located upon conveyors 175. As mentioned previously, the length and speed of conveyor 175 will be a function of both the required residence time in order to sufficiently soak encrusted particles on the articles and to act as a buffer for receiving a continuous supply of articles so as to avoid bottlenecks at any of the sections downstream.

The high pressure spray section 130 indicates the high pressure spray 180 directing the spray onto articles on dedicated conveyors 185. The spray water and removed food particles from the dishes are then collected 190 and directed to a sump 195 for draining and waste disposal.

The dishes are then directed to another dedicated conveyor 205 within the ultrasonic section 135. The dishes undergo a final pre-wash stage through an ultrasonic bath 200 for the final removal of any residual food particles. The dishes are then delivered to a loading conveyor 210 for loading to the washing section 140. Whilst the embodiments of FIGS. 2A, 2B and 3 show a transfer of conveyor from the ultrasonic section to the loading section for the washing stage, it may be economic in order to have this transfer stage to be manually arranged. In this way, the operator can decide upon the type of decision process for delivering dishes and cutlery to the specific carriers for the wash section. This would permit a wide variety of dishes and cutlery to be managed by the device 122. Alternatively, a sorting system may be incorporated whereby a finite range of dish types may be automatically sorted and stacked within carriers for the washing section. Further still, each item passing through the device may include an identification tag such as an RFID detect, bar code or other means of automatic identification such that a sorting system identifies the item and sorts it according to the information on the identification tag. To this end, the system may include at least one, and perhaps several, interrogation stations for interrogating the identification tags and storing the information on a database for future use.

The advantage of identification tags such as an RFID or bar code also allows information on the owner of dishes for eventual repackaging as well as the number of times the dish has been cleaned for plate longevity assessment. Thus, such an identification tag may be very useful for the tracking and other information that could be provided for the purposes of receiving and delivering dishes from clients as well as for charging based on a per article basis.

As with the previous embodiments, the dishes passed from the loading conveyor 210 into the washing stage 140 to undergo a spray rinse 215, a final rinse 220 and a sterilization spray 225. For the purposes of removing grease, oil and fat from the dishes and cutlery, any one of the spray rinse 215, the final rinse 220 and the sterilization rinse 225 may include a detergent aspect so as to ensure dissolving of the residue on the plates prior to the blow dry phase 230, 235 and finally unloading 240 from the end of the conveyor 245.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

The invention claimed is:

1. A device for washing consumer articles, the device comprising:

a pre-wash section for removal of particles from the consumer articles, the pre-wash section comprising a number of distinct pre-wash conveyors for conveying the consumer articles through a number of distinct pre-wash stages, the pre-wash stages arranged to be physically separated from each other such that particles from previous pre-wash stages are prevented from being transferred to subsequent pre-wash stages, eliminating cross-contamination;

a wash section succeeding the pre-wash section for removal of residue from the consumer articles conveyed from the pre-wash section; and a wash conveyor for receiving the consumer articles from the pre-wash section and conveying the consumer articles through the wash section;

wherein the pre-wash conveyors and the wash conveyor are separate with the pre-wash conveyors terminating at a commencement of the wash conveyor.

2. The device according to claim 1, wherein the pre-wash stages comprise successively a soaking stage, a high pressure spray stage and an ultrasonic stage.

3. The device according to claim 1, wherein each pre-wash conveyor is arranged to convey the consumer articles from the respective pre-wash stage to the successive pre-wash stage.

4. The device according to claim 1, further comprising at least one interrogation section for interrogating identification tags on the consumer articles.

5. The device according to claim 1, wherein the conveyors are arranged to convey the consumer articles whilst the consumer articles are in crates.

6. The device according to claim 1, further comprising a consumer article sorter located intermediate the pre-wash conveyors and the wash conveyor, the consumer article sorter arranged to receive the consumer articles from the pre-wash conveyors and sort the consumer articles by category into baskets for transfer to the wash conveyor.

7. The device according to claim 1, wherein the wash section comprises a rinsing sprayer.

8. The device according to claim 7, wherein the wash section further comprises a sterilization sprayer and a blow dry station.

9. The device according to claim 1, wherein the consumer articles move upwardly on the pre-wash conveyor when traveling from the final pre-wash stage of the pre-wash section to the wash section.

10. The device according to claim 1, wherein the consumer articles in at least one of the pre-wash stages are not immersed in water.

11. A method for washing consumer articles, the method comprising the steps of:

conveying the consumer articles through a pre-wash section, wherein the pre-wash section comprising a number of distinct pre-wash conveyors for conveying the consumer articles through a number of distinct pre-wash stages;

removing particles from the consumer articles;

transferring the consumer articles from the final pre-wash stage of the pre-wash section to a wash conveyer;

conveying the consumer articles through a wash section; and removing residue from the consumer articles, wherein the pre-wash stages arranged to be physically separated from each other such that particles from previous pre-wash stages are prevented from being transferred to subsequent pre-wash stages, eliminating cross-contamination.

12. The method according to claim 11, wherein the step of removing particles further comprises the steps of:

soaking the consumer articles;

applying a pressurized spray to the consumer articles; and immersing the consumer articles in an ultrasonic bath.

* * * * *